US012590586B2

(12) United States Patent
Swerts et al.

(10) Patent No.: US 12,590,586 B2
(45) Date of Patent: Mar. 31, 2026

(54) COMPRESSOR ASSEMBLY COMPRISING A MOTOR DRIVING ONE OR MORE COMPRESSOR ROTORS AND METHOD FOR FABRICATING A HOUSING PART OF SUCH A COMPRESSOR ASSEMBLY

(71) Applicant: Atlas Copco Airpower, Naamloze Vennootschap, Wilrijk (BE)

(72) Inventors: Thomas Luc Swerts, Wilrijk (BE); Flip Frans Mathys, Wilrijk (BE)

(73) Assignee: Atlas Copco Airpower, Naamloze Vennootschap, Wilrijk (BE)

( * ) Notice: Subject to any disclaimer, the term of this patent is extended or adjusted under 35 U.S.C. 154(b) by 0 days.

(21) Appl. No.: 18/681,974

(22) PCT Filed: Jul. 12, 2022

(86) PCT No.: PCT/EP2022/069474
§ 371 (c)(1),
(2) Date: Feb. 7, 2024

(87) PCT Pub. No.: WO2023/016737
PCT Pub. Date: Feb. 16, 2023

(65) Prior Publication Data

US 2025/0122877 A1 Apr. 17, 2025

(30) Foreign Application Priority Data

Aug. 12, 2021 (BE) ..... 2021/5642
Mar. 30, 2022 (BE) ..... 2022/5229

(51) Int. Cl.
*F04C 29/02* (2006.01)
*F04C 18/14* (2006.01)
*F04C 29/04* (2006.01)

(52) U.S. Cl.
CPC ..... *F04C 29/025* (2013.01); *F04C 18/14* (2013.01); *F04C 29/045* (2013.01); *F04C 2240/40* (2013.01)

(58) Field of Classification Search
CPC ..... F04C 29/025; F04C 18/14; F04C 29/045; F04C 2240/40
See application file for complete search history.

(56) References Cited

U.S. PATENT DOCUMENTS 4,693,736 A 9/1987 Klusmier
5,222,874 A 6/1993 Unnewehr et al.
(Continued)

FOREIGN PATENT DOCUMENTS

CN 207801640 U 8/2018
EP 1366297 A1 12/2003
(Continued)

OTHER PUBLICATIONS

Office Action with translation cited in corresponding Patent Appln. 2024-506686 dated Dec. 18, 2024.
(Continued)

*Primary Examiner* — Jesse S Bogue
(74) *Attorney, Agent, or Firm* — BACON & THOMAS, PLLC

(57) ABSTRACT

A compressor assembly includes a motor which drives one or more compressor rotors having an oil circulation system including an oil reservoir, an oil cooler and an oil filter, an oil-pump for circulating oil from the oil reservoir to components to be cooled and/or lubricated and back to the oil reservoir wherein the motor has a motor jacket with channels extending in axial directions parallel to the axial direction of a motor shaft in which oil of the oil circulation system circulates.

23 Claims, 8 Drawing Sheets

(56) References Cited

U.S. PATENT DOCUMENTS

| | | | | |
|---|---|---|---|---|
| 9,982,687 | B2 * | 5/2018 | Mitsuda | H02K 7/14 |
| 2004/0146414 | A1 * | 7/2004 | Nichol | F04C 29/0085 417/410.4 |
| 2018/0258952 | A1 * | 9/2018 | Meeusen | H02K 5/203 |
| 2020/0102964 | A1 * | 4/2020 | Nakane | F04D 29/061 |

FOREIGN PATENT DOCUMENTS

| | | | | |
|---|---|---|---|---|
| EP | 1500804 | A2 * | 1/2005 | F02C 7/10 |
| JP | 2005-54779 | A | 3/2005 | |
| JP | 2007-20333 | A | 1/2007 | |
| JP | 2016-186238 | A | 10/2016 | |
| JP | 2018-145965 | A | 9/2018 | |
| JP | 6778581 | B2 * | 11/2020 | F04C 18/16 |
| WO | WO-02070900 | A1 * | 9/2002 | F04C 29/0007 |
| WO | 2013126969 | A1 | 9/2013 | |
| WO | 2018079196 | A1 | 5/2018 | |
| WO | 2018083579 | A1 | 5/2018 | |

OTHER PUBLICATIONS

International Search Report and Written Opinion in corresponding PCT Application No. PCT/EP2022/069474, dated Oct. 31, 2022.
BE Search Report in corresponding BE Application No. 202205229, dated Nov. 14, 2022.

* cited by examiner

COMPRESSOR ASSEMBLY COMPRISING A MOTOR DRIVING ONE OR MORE COMPRESSOR ROTORS AND METHOD FOR FABRICATING A HOUSING PART OF SUCH A COMPRESSOR ASSEMBLY

TECHNICAL FIELD

The present invention relates to a compressor assembly comprising a motor which drives one or more compressor rotors of a compressor element.

The compressor assembly also comprises an oil circulation system for cooling and lubricating components of the compressor assembly. This oil circulation system comprises an oil reservoir and oil is circulated through oil lines of the oil circulation system from the oil reservoir to the concerned components to be lubricated or cooled and back to the oil reservoir.

Furthermore, the oil circulation system also comprises an oil cooler for cooling oil circulating through the oil circulation system and an oil filter for filtering oil flowing through one or more lines of the oil circulation system.

The invention is specifically interesting for compressor assemblies wherein the compressor element is an oil-free or oil-less compressor element, which means that no oil for lubrication is injected between the compressor rotors itself of the compressor element, while other components such as bearings and gearing are usually lubricated by the oil of the oil circulation system. The reason for using an oil-free or oil-less compressor element is that the fluid to be pressurized or compressed in the compressor element is kept free from oil or uncontaminated by oil. This is for example very important in food processing applications and so on.

Nevertheless, the invention is not restricted to compressor assemblies comprising an oil-free or oil-less compressor element and compressor assemblies comprising for example an oil-injected compressor element are not excluded from the invention.

Different techniques can be used to compress or pressurize a fluid in a compressor element. The present invention is related to a compressor assembly wherein the compressor element is a rotary compressor element having compressor rotors driven by the motor for a rotational movement.

The motor is typically an electric motor, but it can be a combustion engine, or it can in principle be any other type of rotational driver or activator or combination of devices for generating a rotational movement.

The motor of a compressor assembly according to the invention has a motor housing comprising a central motor housing body executed as a jacket in which channels are provided which are connected to oil lines of the oil circulation system for circulating oil through the motor jacket.

Typically, the motor housing is interconnected with a compressor housing of the compressor element for forming a compressor assembly housing of the compressor assembly.

In a possible embodiment the motor housing consists entirely and solely of the motor jacket, which is directly connected to an interconnecting flange for connecting the motor housing to the compressor housing. In other embodiments, typically in cases where the motor is pre-assembled before connecting the motor to the compressor element of the compressor assembly, the motor housing can be executed with a flange, or a cover provided at one side or at each of both opposite sides of the central motor housing body which is forming the motor jacket.

The motor has a motor shaft which essentially extends through the motor housing and possibly through a part of the compressor housing and this motor shaft has a drive side where the motor shaft is connected or coupled to the concerned compressor rotor or compressor rotors.

This can be realized in a direct manner by directly interconnecting or coupling a shaft of a concerned compressor rotor shaft to the motor shaft.

In another embodiment, the coupling or interconnection of the motor shaft and a concerned compressor rotor shaft is realized in an indirect manner by means of an intermediate gearwheel transmission or gearbox. Such a gearwheel transmission or gearbox is typically housed in an intermediate gearwheel transmission housing, which is positioned in between the compressor housing and the motor housing.

The compressor element of the compressor assembly is intended for compressing or pressurizing a fluid, typically a gaseous fluid such as air or another gas, such as oxygen, carbon dioxide, nitrogen, argon, helium or hydrogen. It is however not excluded from the invention that the compressor element is used for compressing or pressurizing a denser fluid, such as water vapor or the like.

BACKGROUND

Compressor assemblies comprising an oil-free or oil-less or oil-injected compressor element which is directly or indirectly by means of a gear transmission coupled to a motor are known according to the state of the art.

Regardless of whether the compressor element is an oil-free or oil-less or an oil-injected compressor element, a lot of elements or components of such a compressor assembly need to be lubricated or cooled by oil. For that reason, the compressor assembly comprises an oil circulation system.

Elements or components of the compressor assembly that needs lubrication cooling by oil typically include: gearwheels, such as timing gears or gearwheels of a gearwheel transmission between the compressor element and the motor of the compressor assembly; a compressor outlet; bearings of a compressor rotor shaft; a motor shaft bearing; and so on.

Oil driving means for circulating the oil through the oil circulation system can consist of the compressor rotors of the compressor assembly itself or of other oil driving means or in combination.

For cooling the motor of the compressor assembly, the motor housing is executed as a jacket provided with channels in which oil of the oil circulation system can flow.

An oil reservoir or oil sump, an oil pump, an oil cooler and an oil filter are usually also included in the oil circulation system.

Many oil injection lines and oil drain lines are needed for circulating oil from the oil reservoir to the motor housing jacket and to the components or elements of the compressor assembly to be lubricated or cooled and back to the oil reservoir. These lines also interconnect the oil driving means, the oil cooler and oil filter with each other or with elements and components of the compressor assembly.

It is easily understood that the amount of oil lines and components involved makes a good, compact, and efficient design rather complicated.

What's more, at places where oil lines must be connected to one of the afore-mentioned elements or components of the compressor assembly or the oil circulation system there is a need for a proper sealing.

The more components and lines are involved, the greater is the risk of oil leaking at one point or another. This is a great danger for the proper functioning of the compressor assembly and for a proper lubrication and/or cooling of its vital elements. Such situations should therefore also be avoided as much as possible.

Therefore, the big challenge of designing a proper compressor assembly of the type of concern is to integrate all the required oil circuit components (e.g., oil pump, piping, cooling channels, injection channels, oil filter, breather, other elements) in a compact way in order to reduce the required number of components and space, footprint of the compressor element.

A possible way reducing of oil lines and interconnections is to integrate them at least partly in the housing of the compressor assembly or a part of it, for example in the motor housing or in a part of the motor housing.

To integrate channels or oil lines and other functionalities in a mechanical armature, a manufacturing process wherein the armature or housing is casted, is very well suited. The casting technology allows to design parts with complex 3D shapes and internal cavities in a cost-efficient way and it allows the introduction of more complex functionality in an easy way.

Another advantage of applying a casting fabrication process is that the tooling cost (for producing the molds and for machining the housing after casting, for example for realizing fixtures) is relatively low. Therefore, when a motor or compressor assembly is designed for a dedicated purpose, in standard practice a casted housing model is proposed.

Also, it appears that a casted housing has a relatively good vibrational behavior, which is advantageous for as far as the lifetime of the housing as well as of the components mounted in that housing is concerned, the level of noise generated by the housing and so on.

A disadvantage of a casting mold is, however, that it is less suited if large variance is present in the different required design variants (e.g., different motor lengths depending on the frame size), since each design variant would require its own casting mold.

A casting manufacturing process is therefore also very labor-intensive and thus expensive when the number of armatures or housings to be produced is rather restricted and when a lot of different design models are involved.

Furthermore, in applications wherein the concerned compressor assembly is comprising a compressor element which is an oil-free or oil-less compressor element, particular problems must be solved.

Indeed, in oil-injected compressor elements the oil is circulated in the oil circulation system by a pumping force generated by the compressor rotors of the compressor element itself. This is possible since oil is injected between those compressor rotors.

In an oil-free or oil-less compressor element however this is not possible since contamination of the pressurized fluid by lubrication oil is completely unacceptable in such an oil-free or oil-less compressor element.

Consequently, the role of generating a pumping force for pumping the oil in the oil circulation system cannot be taken by the compressor rotors, but an additional oil driving means or an oil driving means with an increased capacity for generating a pumping force, such as an oil pump, which is placed outside the compression chamber should be provided for that purpose.

This means that in an application wherein the compressor assembly comprises an oil-free or oil-less compressor element the need for integration of an additional oil pump or other oil driving means and/or additional oil lines in the compressor assembly design is generally higher than in oil-injected compressor applications. The problem of coming to a compact and efficient design and nicely integrated design of such a compressor assembly with an oil-free or oil-less compressor element is for the same reasons relatively more complex.

Also, in an oil-free or oil-less compressor element there is a need for an additional oil-pump or oil driving means or for increasing the capacity of such an oil-pump or oil driving means for pumping oil through the oil circulation system of a compressor assembly, which implies extra costs for the added components and/or due to increased energy consumption.

Another important aspect related to the present invention is that in an oil-injected compressor element all the lubrication and cooling oil is usually circulated under the pressure delivered by the compressor rotors. The requirements on the quality of this lubrication and cooling oil is high since the complete flow of oil passes through the compressor room between the compressor rotors. For a reliable functioning of the compressor element, it is important that this lubrication and cooling oil is free from contamination, which is obtained by passing the oil through an oil-filter. The filter requirements in an oil-injected compressor element are therefore very high.

On the other hand, in an oil-free or oil-less compressor element no oil is injected between the compressor rotors. The requirements for filtering the lubrication and/or cooling oil are therefore different from what is the case in an oil-injected compressor element.

Clearly, when designing a compressor assembly, a lot of different aspects must be taken into account, such as the number of components and devices and oil line connections between these components and devices incorporated in the assembly, the cost and complexity of the manufacturing, the quality and purity of the lubrication and/or cooling oil in certain parts of the assembly, the size and power of the assembly, and so on. So, designing such a compressor assembly in a compact, cost-effective, and reliable manner involves a lot of engineering and is far from obvious.

SUMMARY OF THE INVENTION

It is an aim of the invention to overcome one or more of the afore-mentioned problems and/or possibly still other problems.

It is particularly a goal of the invention to provide a more integrated design of a compressor assembly, wherein oil line connections and the need for sealing those connections is reduced substantially, so that there is less risk for failure or reduced performance of the compressor assembly caused by leaking lubrication or cooling oil or by contamination of that oil.

Another aim of the present invention is to provide a solution which is cost effective and allowing a relatively easy adaptation of a design of a compressor assembly, especially as far as its length is concerned, without the need for costly modifications to its manufacturing process.

Still another objective of the present invention is to provide a compressor assembly with an optimized or improved oil filtering system, wherein lubrication and/or cooling oil is filtered in a way which is adapted to the needs of involved components of the compressor assembly.

A further aim of the invention is to realize one or more of the afore-mentioned objectives in a compressor assembly which comprises a compressor element which is an oil-free or oil-less rotor compressor element.

Finally, it is also an aim of the invention to develop a compact compressor assembly wherein a motor shaft is coupled to a compressor rotor shaft directly or indirectly through a gear transmission of preferably limited size and wherein motor, compressor element and possible gear transmission are integrated in a compressor assembly housing.

To this end, the present invention relates to a compressor assembly comprising a motor which drives one or more compressor rotors of a compressor element, comprising an oil circulation system for cooling and lubricating components of the compressor assembly, wherein the oil circulation system comprises an oil reservoir, an oil cooler for cooling oil circulating through the oil circulation system, and an oil filter for filtering oil flowing through one or more lines of the oil circulation system, wherein the motor has a motor housing comprising a central motor housing body executed as a jacket in which channels are provided which are connected to oil lines of the oil circulation system for circulating oil through the motor jacket, wherein the oil circulation system comprises an oil pump for providing driving force for circulating oil through oil lines of the oil circulation system from the oil reservoir to the concerned components to be cooled and/or lubricated and back to the oil reservoir and wherein the channels in the motor jacket are extending in axial directions parallel to an axial direction of a motor shaft of the motor.

A first important aspect of such a compressor assembly in accordance with the invention is that it is provided with an oil-pump for circulating oil through oil lines of the oil circulation system of the assembly.

A great advantage of this aspect is that the oil-pump provides at least part of the needed driving force for the circulation of oil through the oil circulation system. As a consequence, the oil is not necessarily pumped by a driving force provided by the compressor rotors of the compressor assembly and therefore the compressor assembly is suitable for oil-free as well as for oil-injected types of compressor elements.

Another important aspect of such a compressor assembly in accordance with the invention is that the channels in the motor jacket are extending in axial directions parallel to an axial direction of a motor shaft of the motor. This means that the central motor housing body can be made with a cross-sectional area perpendicular to the motor shaft which is constant or invariable when considered in said axial direction(s), i.e., in the direction of the length of the motor or a part of it.

An advantage of such a compressor assembly in accordance with the invention is therefore that a same manufacturing method can be used for fabricating central motor housing bodies of different lengths for a motor of the compressor assembly, and compressors assemblies of varying lengths can thus easily be produced. Obviously, in housings of a compressor assembly with increasing lengths devices with increasing driving power or compression power or compression pressures or flow rates can be installed.

This is advantageous in that different compressor assemblies can be made, with rather varying characteristics and even in not too large quantities without substantially increasing the production cost and/or complexity.

Another advantage of such a compressor assembly in accordance with the invention wherein channels in the motor jacket are extending in axial directions parallel to an axial direction of a motor is that oil can be transported from one side to the opposite side through the motor jacket. Such a configuration is very efficient for transporting oil through the jacket and results in an easy flow of oil and thus in a high cooling or oil transport capacity.

These axially directed channels can also be easily combined or connected to one another in caps, flanges or covers provided at the opposite sides of the motor jacket, so that different configurations for guiding oil or other substances such as water through the motor jacket can be easily composed by just using caps or covers with different inner channels, even with a single type of motor jacket.

In a preferred embodiment of a compressor assembly according to the invention the oil-pump is integrated in the motor housing or is mounted on a motor housing cover or on another part of the compressor assembly housing provided at a non-drive side or at a drive side of the central motor housing body and is driven by the motor shaft of the motor.

The non-drive side is opposite to the drive side of the central motor housing body, which drive side is the side of that central motor housing body where the motor is driving the compressor rotors of the compressor element.

A great advantage of such an embodiment of a compressor assembly of the invention is that a very compact compressor assembly of restricted size can be realized in which many elements of the compressor element are integrated in an efficient and logical way.

Indeed, the oil-pump is brought very close to the motor and its motor shaft and can therefore be driven by said motor shaft together with the compressor rotors of the compressor assembly, so that no additional driving means are required for driving the oil pump.

Another advantage of such an embodiment of a compressor assembly in accordance with the invention wherein an oil-pump is directly driven by the same motor of the compressor assembly which is also driving the compressor element and is not driven by additional, external driving means, is that it is more efficient and more reliable to include the oil pump as mechanical part directly coupled to the main motor. In this way, lubrication of bearings is always guaranteed when the motor is running, if at least there are no mechanical failures or no obstructions in the oil circuit. An electrically driven external oil pump is less reliable, since a simple communication failure might prevent the pump from running when the machine starts up. Too long "dry running" without lubrication will cause detrimental damage to the bearings of the motor and/or compressor element or intermediate gearing.

In a preferred embodiment of a compressor assembly according to the invention, the oil-pump is furthermore at its outlet directly connected to an afore-mentioned axially directed channel in the central motor housing body.

A great advantage of such an embodiment of a compressor assembly of the invention is that an oil pressure line of the oil pump is also integrated in the motor housing, so that no additional external oil line must be coupled to the oil pump outlet. It allows also for a very robust design, reducing substantially the risk for oil leaks at the outlet of the oil pump. Furthermore, with such a design, failure of an external oil line at the oil-pump outlet, for example caused by accidental disruption or material fatigue, cannot occur, so that the reliability of the compressor assembly is increased.

The afore-mentioned preferred characteristics of compressor assembly in accordance with the invention are especially very advantageous for application in embodiments wherein the compressor element of the compressor assembly is an oil-free or oil-less compressor element.

Indeed, in an oil-free or oil-less compressor assembly there is always a need for an oil-pump which generates the driving force for pumping lubrication or cooling oil through the oil circulation system.

Furthermore, oil-injected types of compressor elements are used on a large scale, in large quantities and they have a large variance in drive motor frame sizes, while oil-free or oil-less compressor elements are less frequently used, are produced in smaller quantities and there is less variance in size or capacity.

An additional advantage of the provided solution with axially aligned channels in a central motor housing body is that it makes the production possible of motor housings with different lengths in an identic or almost identic fabrication process. This opens the way for the fabrication of varying types of compressor assemblies with an oil-free or oil-less compressor element at an acceptable cost, even if only small batches of each type need to be produced.

In a preferred embodiment of a compressor assembly according to the invention the central motor housing body is therefore fabricated by extrusion.

An extrusion process is of course very suitable for fabricating objects having a cross-section which is invariable or almost invariable in an axial direction.

An extrusion process is also extremely interesting when objects of varying lengths, but with similar cross-section or profile must be manufactured, which is completely not the case when a casting process is used, since any modification to a design would require a different mold.

Indeed, a same extrusion die can be used for manufacturing a part with the same extrusion profile for various lengths. On the other hand, compared to a casting process, extrusion technology requires a higher initial investment.

Nevertheless, since the same extrusion die can be used for motor housings of varying length, the disadvantage of higher initial investment can be compensated by the advantage that the same extrusion technology can be used for different types of housings without any extra investment, which is not the case when casting technology is applied. So, the total amount of products (of different types) to be produced can be high enough to justify the initially high investment.

What's more, the technique is more practical for producing motor housings of different lengths, so that the overall advantage of extrusion is largely compensating the burden of initial high investment. This is especially interesting for producing compressor assemblies comprising an oil-free compressor element, since the oil-free market is such that only smaller batches of each type of compressor assembly are required.

In still another preferred embodiment of a compressor assembly according to the invention the oil circulation system of the compressor assembly comprises at least a first circulation loop and a second circulation loop wherein oil is circulating between the oil reservoir and the oil cooler and back, the first circulation loop being an unfiltered circulation loop wherein no oil filter is included and the second circulation loop being a filtered circulation loop in which the oil filter is provided for filtering the oil, while one or more channels in the motor jacket are included in the first unfiltered circulation loop, which channels are forming cooling channels for cooling of the motor housing jacket.

In such an embodiment of a compressor assembly in accordance with the invention not all the oil circulating through the oil circulation system must be filtered constantly. Instead, the total flow of oil in the oil circulation system is divided into two streams of oil which are flowing through two different circulation loops, i.e., a filtered circulation loop and an unfiltered circulation loop.

Importantly, the oil flow through the motor jacket for cooling it is part of the unfiltered circulation loop and this oil flow is generally rater large compared to the flow of filtered oil for lubricating bearings and gearing of the compressor assembly.

This is a very advantageous configuration. Indeed, the lifetime of a filter is defined by a) contamination of the oil and b) the flow rate passing through the filter. In an embodiment of a compressor assembly as here discussed, most of the oil flow rate is used for cooling without being filtered. Therefore, the lifetime of the filter of the oil circulation system is increased to a great extent by only filtering the more limited oil flow of oil used for lubrication.

This needs some explanation. Filtering all the oil of the oil circulation system and thus using also filtered oil as cooling medium has in a way also a certain advantage, since it might allow for a slightly less complex mechanical design. Indeed, the motor bearings can in that case for example be lubricated by means of filtered oil provided through lubrication points which can be formed by simple bleed-off points drawing off filtered oil from the channels in the motor jacket. Such a simple design for bringing filtered oil to the motor bearings is not possible when the channels in the motor jacket are transporting cooling oil which is not filtered.

A disadvantage however of filtering all the oil of the oil circulation system is that the system needs more frequently to be serviced. Or, as an alternative an oversized oil filter should be used. Also, the pressure drop over an oil filter increases quadratically with the flow rate going through it. So, for reducing this pressure drop the size of the filter must be large enough in order to keep the flow rate through the filter sufficiently low. This is also problematic in the case the filtered oil is not only serving for lubrication purposes, but also for cooling purposes.

The characteristic of the invention to split the total oil flow in a filtered circulation loop for lubrication and an unfiltered circulation loop for cooling is a smart way of designing a compressor assembly. The disadvantage of rendering the design slightly more complicated for as far as supplying filtered lubrication oil to some parts of the assembly is concerned, is largely compensated by the advantages that smaller oil filters can be used and that oil filters have a longer lifetime and need to be serviced less frequently. By integrating filtered oil lines and unfiltered oil lines in the motor jacket in an intelligent manner, such a design in accordance with the invention is also very compact, reliable, and robust.

The invention also relates to a method for fabricating a housing part of a compressor assembly in accordance with the invention as described before. In such a method of the invention, the manufacturing of the central motor housing body of the compressor assembly comprises an extrusion step for forming a motor jacket with axially directed channels.

As explained before, the extrusion process is very practical and effective, and it is also suitable for fabricating housing bodies of varying length in relatively small batches.

BRIEF DESCRIPTION OF THE DRAWINGS

The invention will further be illustrated with references to the drawings, wherein.

DETAILED DESCRIPTION OF EMBODIMENT(S)

Figure 1:
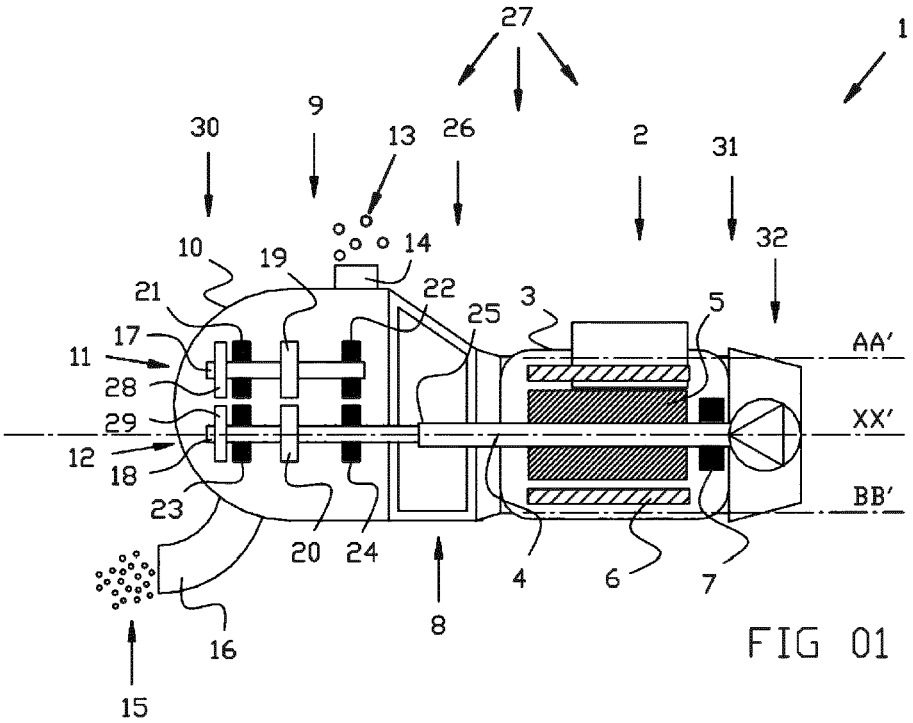
FIG. 1 is a cross-sectional schematic drawing of a part of a first embodiment of a compressor assembly in accordance with the invention.

FIG. 1 illustrates a part of a first embodiment of a compressor assembly 1 in accordance with the invention. The compressor assembly comprises a motor 2, which is in this case an electric motor, which is mounted in a motor housing 3 and which comprises a motor shaft 4 extending in an axial direction XX' through the motor housing 3. The motor shaft 4 is provided with a motor rotor 5 which is rotating with the motor shaft 4 in motor stator windings 6 which are fixedly mounted in the motor housing 3. The rotor shaft 4 is supported in the motor housing 3 in a rotatable manner by means of a motor shaft bearing 7. As an alternative it is not excluded from the invention to use a pair of motor shaft bearings for that purpose.

At a drive side 8 of the motor 2, a compressor element 9 is coupled to the motor 2. As explained in the introduction, the invention is of particular interest for compressor assemblies 1 wherein this compressor element 9 is an oil-free or oil-less compressor element 9.

The compressor element 9 is mounted in a compressor housing 10 and comprises compressor rotors 11 and 12 which can work with one another for compressing fluid 13 supplied to the compressor element 9 at a compressor inlet 14. Compressed or pressurized fluid 15 is discharged at a compressor outlet 16 for being supplied to a consumer or a network of consumers of pressurized or compressed fluid 15.

The compressor rotors 11 and 12 comprise each a compressor rotor shaft, respectively compressor rotor shaft 17 and compressor rotor shaft 18, on which in a central part a rotor is provided, respectively compressor rotor 19 and compressor rotor 20. The compressor rotor 19 can be a female rotor 19 which is collaborating with a male rotor 20 which is forming the other compressor rotor 20, or vice versa. In practice, the compressor rotors 19 and 20 can each for example be a screw rotor of a screw compressor, or a tooth rotor of a tooth compressor, but other types are not excluded from the invention.

The compressor rotor shafts 17 and 18 are each supported in a rotatable manner in the compressor housing 10 by a pair of compressor shaft bearings, respectively a pair of compressor shaft bearings 21 and 22 and a pair of compressor shaft bearings 23 and 24.

In order to drive the compressor element 9, or more precisely the compressor rotors 11 and 12 of the compressor element 9, by means of the electric motor 2, the motor shaft 4 is coupled in a direct manner to the compressor rotor shaft 18 of the compressor rotor 12 by a direct coupling 25 of the concerned shafts 4 and 18. The coupling 25 between a free end of the motor shaft 4 and a free end of the compressor rotor shaft 18 is located in an intermediate housing compartment 26 provided between the motor housing 3 and the compressor housing 10.

The motor housing 3, the compressor housing 10 and the intermediate housing compartment 26 form together the compressor assembly housing 27.

In this case the compressor rotor 12 is directly driven by the motor shaft 4, while the compressor rotor 11 is driven indirectly by means of the interaction between a couple of timing gears 28 and 29, mounted at a non-drive end 30 of respectively the compressor rotor shaft 17 and the compressor rotor shaft 18.

Finally, at a non-drive side 31 of the motor 2, i.e., the side opposite to the drive side 8 where the motor 2 is coupled to the compressor element 9, the compressor assembly 1 is furthermore provided with on oil pump 32. This oil-pump 32 is integrated in the motor housing 3 or is mounted on the motor housing 3 or on a motor housing cover of that motor housing 3.

This oil-pump 32 is also directly driven by the motor shaft 4 of the electric motor 2 and is intended for providing a driving force for circulating oil in an oil circulation system 33 of the compressor assembly 1. This oil circulation system 33 is intended for providing oil to components of the compressor assembly 1 for lubrication purposes or for cooling purposes or both.

Components of the compressor assembly 1 that typically need lubrication are for example bearings such as motor shaft bearing 7 or compressor shaft bearings 21 to 24, or are gears, such as timing gears 17 and 18. A component that needs cooling is for example the electric motor 2, compressed fluid 15 at an outlet 16 of the compressor element 9, the compressor element 9 itself or other elements of the compressor assembly 1. The oil circulation system 33 is not represented in FIG. 1, but it will be discussed more in detail with respect to FIGS. 3 and 4, for example.

Figure 2:
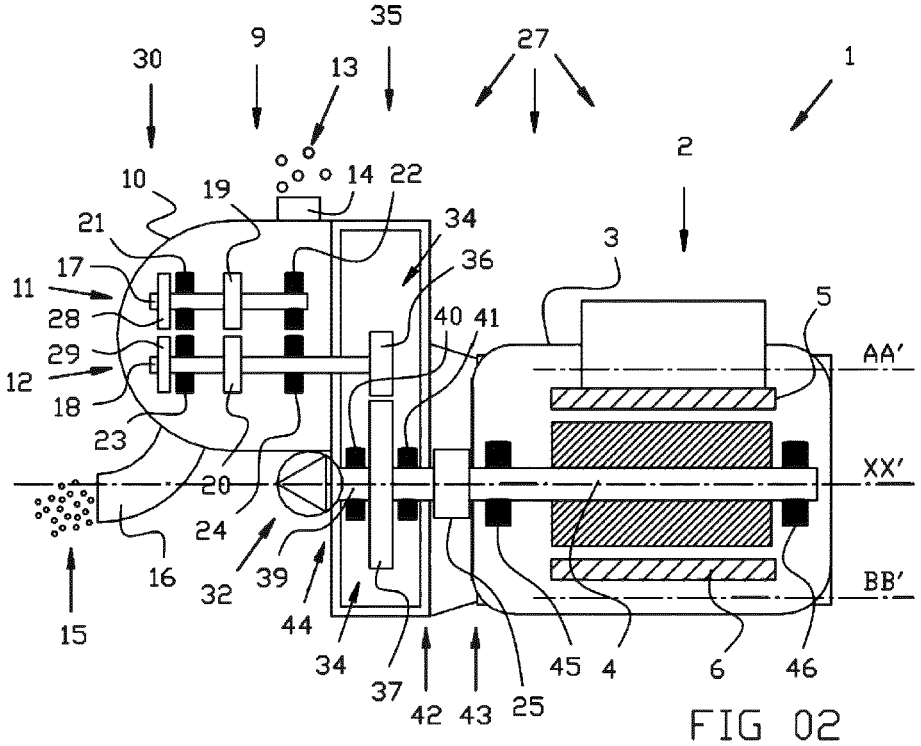
FIG. 2 is a similar cross-sectional schematic drawing of a part of a second embodiment of a compressor assembly in accordance with the invention.

FIG. 2 illustrates a part of a second embodiment of a compressor assembly 1 in accordance with the invention, which is very similar with the embodiment represented in FIG. 1.

A first difference with the embodiment of FIG. 1 is that the motor shaft 4 is this time not coupled by a direct coupling 25 to a compressor rotor shaft 18, as was the case in FIG. 1. In the embodiment of FIG. 2 the motor shaft 4 is coupled or interconnected to the compressor rotor shaft 18 of the compressor element 9 in an indirect manner by means of an intermediate gearwheel transmission 34 or gearbox. This intermediate gearwheel transmission 34 or gearbox is housed in an intermediate gearwheel transmission housing 35, which is positioned in between the compressor housing 10 and the motor housing 3.

The intermediate gearwheel transmission 34 is in this case composed of a pair of gearwheels 36 and 37 which intermesh. The gearwheel 36 is a driven pinion gear 36 which is mounted fixedly at a free end 38 of the compressor rotor shaft 18, which is extending into the intermediate gearwheel transmission housing 35.

The other gearwheel 37, often designated as being a bull gear 37, of the intermediate gearwheel transmission 34 is a driving gearwheel 37 which is mounted fixedly on an additional gearwheel transmission shaft 39, which is supported rotatably in the intermediate gearwheel transmission housing 35 by means of a pair of bearings 40 and 41.

The additional gearwheel transmission shaft 39 is directly coupled to the motor shaft 4 by means of a direct coupling 25 which couples a free end 42 of the additional gearwheel transmission shaft 39 to a free end 43 of the motor shaft 4. The concerned shafts 4 and 39 are both extending into an intermediate housing compartment 25. In a possible embodiment, the direct coupling 25 consists of a flexible coupling which can cope with misalignments of the motor shaft 4 and the gearwheel transmission shaft 39.

This intermediate housing compartment 25 is located between the intermediate gearwheel transmission housing 35 and the motor housing 3, and the compressor housing 10, the intermediate gearwheel transmission housing 35, the intermediate housing compartment 25 and the motor housing 3 form together the compressor assembly housing 27 in this example.

Another difference between the embodiment of FIG. 2 and the embodiment of FIG. 1 is the position of the oil pump 32. In the embodiment of FIG. 2, the oil pump 32 is mounted directly on a free end 44 of the additional gearwheel transmission shaft 39 opposite to the free end 42 of that shaft 39.

The additional gearwheel transmission shaft 39 is extending outwards from the intermediate gearwheel transmission housing 35 in a direction towards the compressor element 9. So, in the case of FIG. 2 it can be said that the oil pump 32 is coupled to the electric motor 2 at a drive side 8 of this motor 2, while in FIG. 1 this oil pump 32 was at the non-drive side 31. It is of course not excluded from the invention to mount the oil pump 32 in a similar position as was the case in the embodiment of FIG. 1, at a non-drive side 31 of the motor housing 3

Still another difference with the first embodiment of FIG. 1 is that in the embodiment of FIG. 2 the motor shaft 4 is not supported by a single bearing 7 but by a pair of motor shaft bearings 45 and 46.

Figure 3:
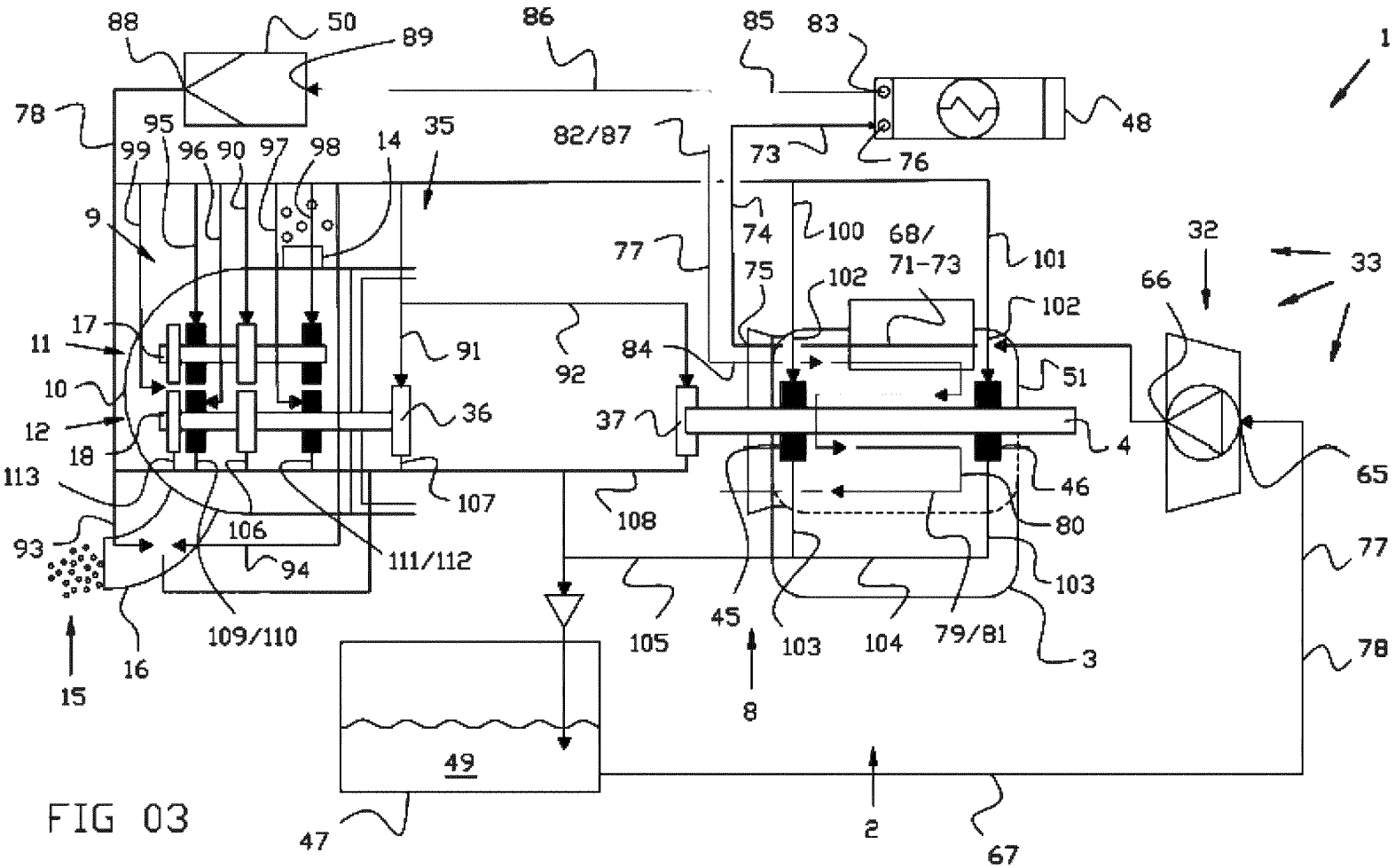
FIG. 3 is a schematic representation of a complete compressor assembly in accordance with the invention comprising an oil-free compressor element with pre-cooled oil injection.

FIG. 3 illustrates schematically a compressor assembly 1 according to the invention in its entirety. Elements already described with respect to FIGS. 1 and 2 are repeated in this FIG. 3 in a kind of exploded view way. Other elements of the compressor assembly 1 are added which are mainly illustrating details of the oil circulation system 33 for cooling and lubricating components of the compressor assembly 1.

This oil circulation system 33 comprises an oil reservoir 47, an oil cooler 48 for cooling oil 49 circulating through the oil circulation system 33, and an oil filter 50 for filtering oil 49 flowing through lines of the oil circulation system 33.

For circulating oil 49 through the oil lines of the oil circulation system 33 from the oil reservoir 47 to the concerned components of the compressor assembly 1 to be cooled and/or lubricated and back to the oil reservoir 47, the oil circulation system 33 comprises also an oil pump 32 which provides the needed driving force. According to the invention this oil-pump 32 is preferably integrated in the motor housing 3 or is mounted on a motor housing cover provided at a non-drive side 31 of the motor housing 3.

This is advantageous, first of all since the oil-pump 32 can in that way be driven by the same motor shaft 4 of the electric motor 2 which is driving the compressor rotors 11 and 12 of the compressor element 9. This compact design has still another advantage as will become clear hereafter.

Figure 7:
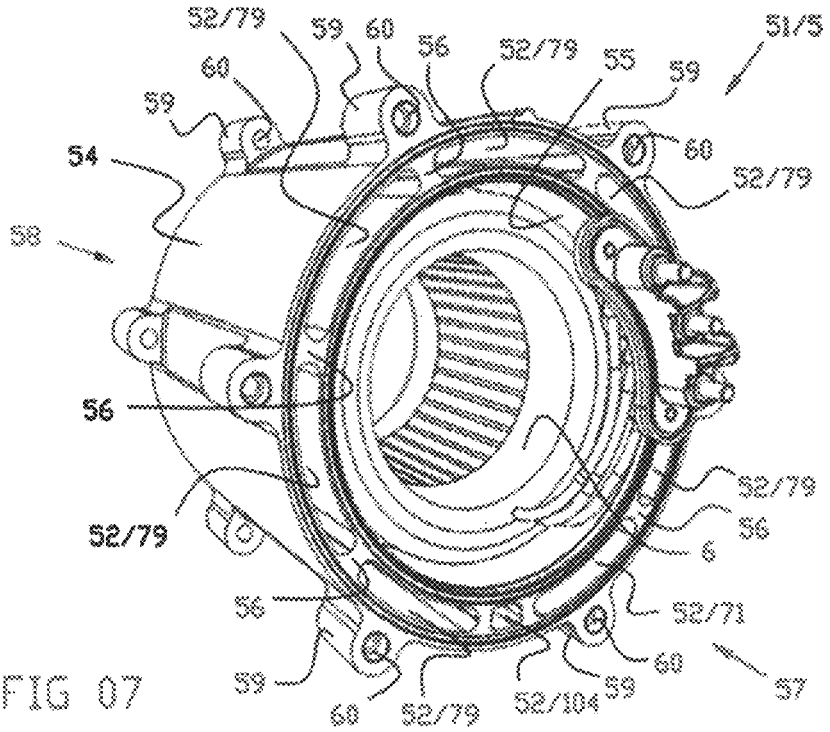
FIG. 7 is a perspective view of the finished central motor housing body of FIG. 6 after a stator has been inserted.
Figure 13:
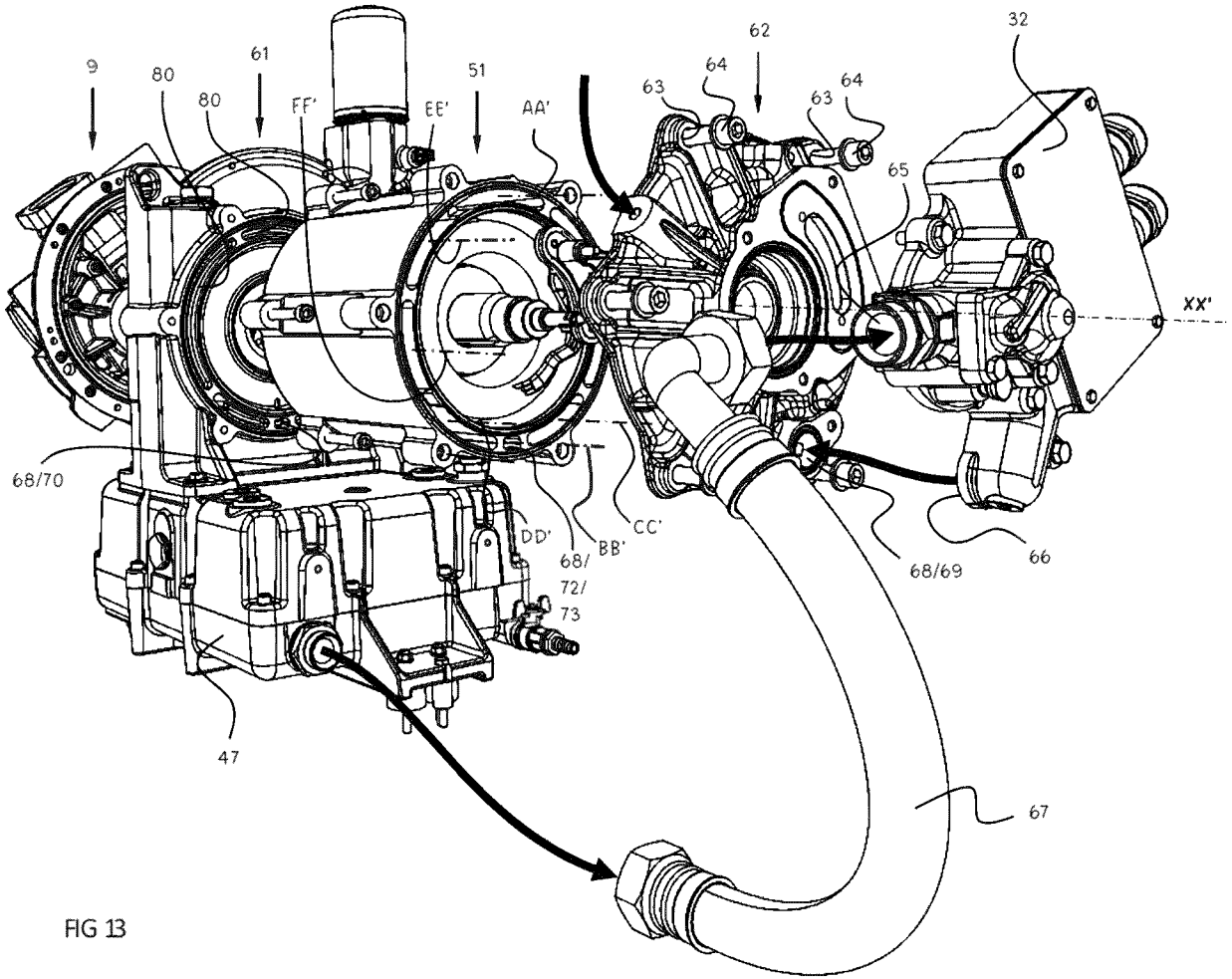

As is illustrated in FIGS. 7 and 13 for example, the motor housing 3 of the motor 2 comprises a central motor housing body 51 executed as a jacket in which channels 52 are provided which are connected to oil lines of the oil circulation system 33 for circulating oil 49 through the motor jacket 51.

Essentially, these channels 52 are for the greater part intended for transporting oil 49 through the motor jacket 51, for cooling the motor 2.

According to the invention these oil channels 52 in the motor jacket 51 are extending in axial directions AA', BB', CC', DD', EE', . . . parallel to the axial direction XX' of the motor shaft 4 of the motor 2 and the oil channels 52 extend through the entire central motor housing body 51 between the non-drive side 31 and the drive side 8 of the motor 2. This is for example clearly illustrated in FIG. 13.

The central motor housing body 51 is formed by an essentially cylindrical element 53 which can be considered as being a double-walled element 53 with an outer wall 54 and an inner wall 55 which are connected to one another by means of partition walls 56, which separate the different channels 52 in the motor jacket 51 from one another. This is for example clearly illustrated in FIGS. 7 and 8. In this case there are eight such channels 52, seven of which having a similar width and occupying the main part of the space between the inner wall 55 and the outer wall 54. The eighth channel 52 at the bottom of the cylindrical element 53 has a substantially smaller width and cross-section. Obviously, according to the invention any other number of channels 52 in the motor jacket can be applied.

At both extremities 57 and 58 of the central motor housing body 51 the outer wall 54 is externally provided with a number of bulges 59, which are each provided with a hole 60, which is possibly an internally threaded hole 60 or a through-hole 60 without internal thread. In the case of the figures, there are at each of the extremities 57 and 58 six such bulges 59 which are spaced apart from one another over the circumference of the cylindrical element 53 in a symmetrical manner.

Furthermore, the central motor housing body 51 is at each side 58 and 59 closed off by means of a motor housing cover 61 and 62 (see FIG. 13). In particular, the motor housing 3 comprises at a drive side 8 of the central motor housing body 51 a drive side motor housing cover 61 adjacent to the compressor rotors 11 and 12 driven by the motor 2 and comprises at a non-drive side 31 of the central motor housing body 51 a non-drive side motor housing cover 62 at the opposite side of the central motor housing body 51.

These covers 61 and 62 are provided with holes 63 and bolts 64 corresponding to the bulges 59 and (threaded) holes 60 for bolting the covers 61 and 62 against the central motor housing body 51.

The oil-pump 32 has an oil-pump inlet 65 and an oil-pump outlet 66. The oil-pump inlet 65 is connected by an oil-suction line 67 to the oil reservoir 47.

Furthermore, in a preferred embodiment of a compressor assembly 1 according to the invention, the motor housing 3 is provided with a pass-through channel 68, which passes through the central motor housing body 51 and through the motor housing covers 61 and 62 provided at the opposite extremities 57 and 58 of the central motor housing body 51. To that purpose the covers 61 and 62 are also provided with pass-through openings 69 and 70 which fit to a channel 71 of the afore-mentioned axially directed channels 52 of the central motor housing body 51, so to form together the pass-through channel 68.

Figure 9:
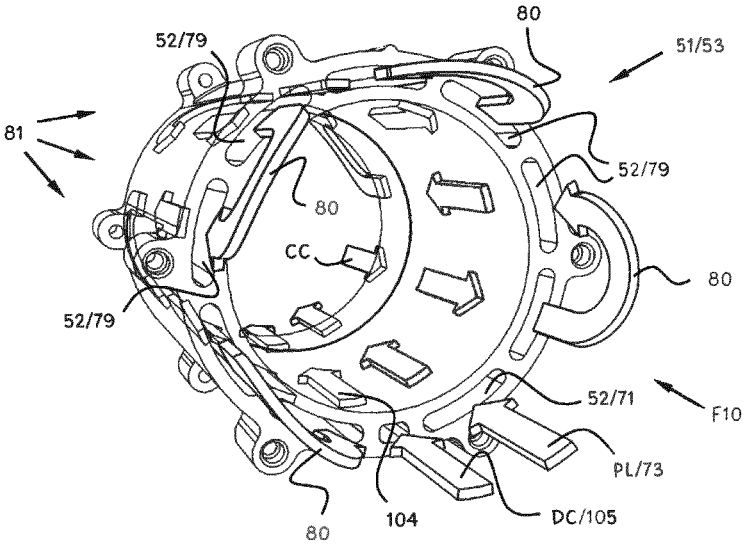
FIG. 9 is a perspective view on the finished central motor housing body similar to the perspective view of FIG. 6 wherein the direction of oil flow in a first configuration is indicated by means of arrows.
Figure 10:
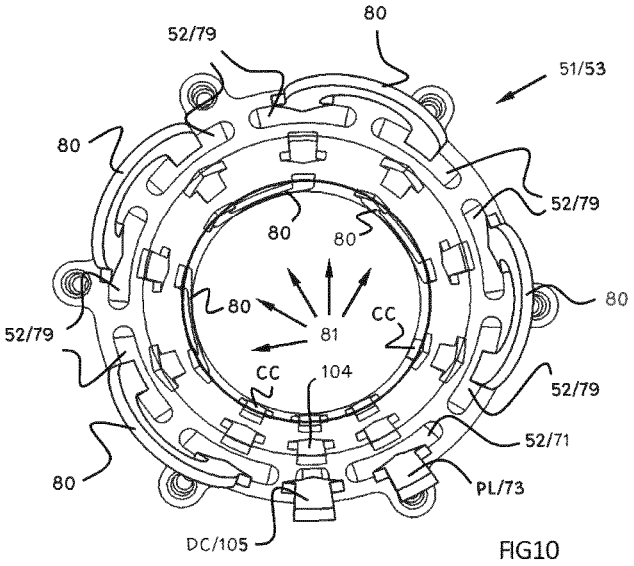
FIG. 10 is a front view along the arrow F10 in FIG. 9 illustrating the same oil flows in the first configuration through the channels in the finished central motor housing body.

It is preferred that the oil-pump 32 is at its outlet 66 directly connected to this pass-through channel 68 for forming a part 72 of an oil-pump pressure line 73 of the oil-pump 32 which is connected to the oil-cooler 48. Reference is also made to FIGS. 9 and 10 in which the channel 71 for the pass-through channel 68 is indicated and wherein the flow of oil 49 through the oil-pump pressure line 73 coming from the oil-pump 32 is indicated by arrows PL.

The remaining part 74 of this oil-pump pressure line 73 which extends between the motor housing 3 and the oil-cooler 48 is formed by an oil-line 74 which is connected at an outlet 75 of the pass-through channel 68 at the drive-side 8 of the motor housing 3. This oil-line 74 is at its other end connected to the inlet 76 of the oil-cooler 48.

The integration of a part 72 of the oil-pump pressure line 73 to the oil-cooler 48 in the motor jacket 51 has a great advantage for as far as the compactness and robustness of the configuration of the compressor assembly 1 is concerned. The risk for oil leaks at the oil-pump outlet 66 is with this configuration also very much reduced.

In the case of FIG. 1, there is only a single oil-line from the oil reservoir 47 to the oil-pump 32 through the motor jacket 51 to the oil-cooler 48, which oil-line is composed of the suction-line 67 and the oil-pump pressure line 73. This means that the totality of the oil 49 sucked by the oil-pump 32 through the suction-line 67 is transferred to the oil-cooler 48, so that all the oil 49 circulated by the oil circulation system 33 of the compressor assembly design 1 is cooled before it is supplied to the different components of the compressor assembly 1 to be cooled and/or lubricated.

Another aspect of the compressor assembly 1 of the invention illustrated in FIG. 1 is that the oil circulation system 33 of the compressor assembly 1 comprises at least one first circulation loop 77 and at least one second circulation loop 78 wherein oil 49 is circulating between the oil reservoir 47 and the oil-cooler 48 and back. The first circulation loop 77 is an unfiltered circulation loop 77 wherein no oil filter 50 is included. The second circulation loop 78 on the other hand is a filtered circulation loop 78 in which the oil filter 50 is provided for filtering the oil 49.

It is not excluded from the invention to provide more than one unfiltered circulation loop 77 and/or more than one filtered circulation loop 78

In a preferred embodiment of a compressor assembly 1 according to the invention, one or more channels 79 of the channels 52 in the motor jacket 51 are included in the first unfiltered circulation loop 77 or one of the present unfiltered circulation loops 77, when there is more than one unfiltered circulation loop 77. These channels 79 are forming motor cooling channels 79 for cooling the motor housing jacket 51 and for transferring heat generated in the motor 2 to the oil 49 flowing through the motor cooling channels 79 and removing this heat in order to cool the motor 2 itself.

As can be deduced from FIG. 13 and is schematically illustrated in FIGS. 9 to 12 by means of arrows, the motor housing covers 61 and 62 comprise one or more interconnection channels 80 which collaborate in the assembled status with axially directed cooling channels 79 in the central motor housing body 51 for interconnecting the concerned cooling channels 79 in the central motor housing body 51 and for forming a single composed cooling channel 81 for cooling of the motor housing jacket 51 and motor 2. This single composed cooling channel is indicated by arrows CC in FIGS. 9 to 12.

FIGS. 9-12 illustrate a compressor assembly 1 with a single composed cooling channel 81. However, in other embodiments of a compressor assembly 1 in accordance with the invention it is of course also possible to provide more than one composed cooling channel 81 or to provide only uncomposed, singular channels, which are in that case all cooling channels 52 which are parallel to one another.

A motor cooling set up could for example be designed wherein a first composed cooling channel 81 is circulating clockwise and a second composed cooling channel 81 is circulating counterclockwise. Such a design is obviously somewhat more complex but has the advantage of halving the flow rate through the composed cooling channels 81. As a result, the pressure drop over the composed cooling channels 81 is also reduced by a factor which is approximately four! This might be particularly interesting for bigger sizes of motors 2 where a large pressure drop over the motor cooling channels 81 might cause too high pressures in the cooling circuit.

For supplying cooled oil 49 to the motor jacket 51 an oil line 82 is provided between an oil-cooler outlet 83 of the oil-cooler 48 and a cooling channel inlet 84 of at least one cooling channel 79 in the central motor housing body jacket 51 or a single composed cooling channel 81.

An oil-line 85 of cooled oil 49 is connected to the oil-cooler outlet 83 which is branched upstream of the oil-filter 50 into a first branch 86 which is forming an oil line 86 towards the oil-filter 50 and a second branch 87 for forming the oil line 82 towards said cooling channel 79 or single composed cooling channel 81 in the motor housing jacket 51.

Furthermore, in the example of FIG. 3 the oil circulation system 33 of the compressor assembly 1 comprises a multitude of oil injection lines for providing cooled filtered lubrication oil 49 to components of the compressor assembly 1 which are connected to the filter outlet side 88 of the filter 50. The oil filter 50 itself is provided in the oil-line 86 of cooled oil 49 which is extending between the oil cooler outlet 83 and the filter inlet side 89. Since in the case of FIG. 3 the oil 49 is cooled before it is injected, the oil circulation system 33 can be considered as begin a pre-cooled oil injection system.

In particular, the oil circulation system 33 is equipped with the following oil injection lines 90-99 for providing filtered lubrication oil to components of the compressor element 9 of the compressor assembly 1:

- a filtered oil injection line 90 towards a compressor rotor 11 and/or 12;
- filtered oil injection lines 91 and 92 towards a driven gearwheel 36 or a driving gearwheel 37 of an intermediate gearwheel transmission 34 between the motor 2 and the compressor element 9;

a non-drive side oil injection line 93 for injecting filtered oil 49 towards a compressor outlet 16;

a drive side oil injection line 94 for injecting filtered oil 49 towards a compressor outlet 16;

a filtered oil injection line 95 towards a non-drive side bearing 21 of a female compressor rotor shaft 17;

a filtered oil injection line 96 towards a non-drive side bearing 23 of a male compressor rotor shaft 18;

a filtered oil injection line 97 towards a drive side bearing 24 of a male compressor rotor shaft 18;

filtered oil injection line 98 towards a drive side bearing 22 of a female compressor rotor shaft 17; and, a filtered oil injection line 99 towards timing gearing 28 or 29.

In the case of an embodiment wherein the compressor element 9 is an oil-less or an oil-free compressor element 9, there is of course no filtered oil injection line 90. Also, in other embodiments more or less oil lines can be applied than is the case in the here-discussed example.

The oil circulation system 33 is also equipped with the oil injection lines 100 and 101 for providing filtered lubrication oil to components of the motor 2 of the compressor assembly 1. In particular is the motor 2 in the case of FIG. 3 provided with:

a drive side filtered oil injection line 100 towards a motor shaft bearing 45; and, a non-drive side filtered oil injection line 101 towards a motor shaft bearing 46.

Figure 8:
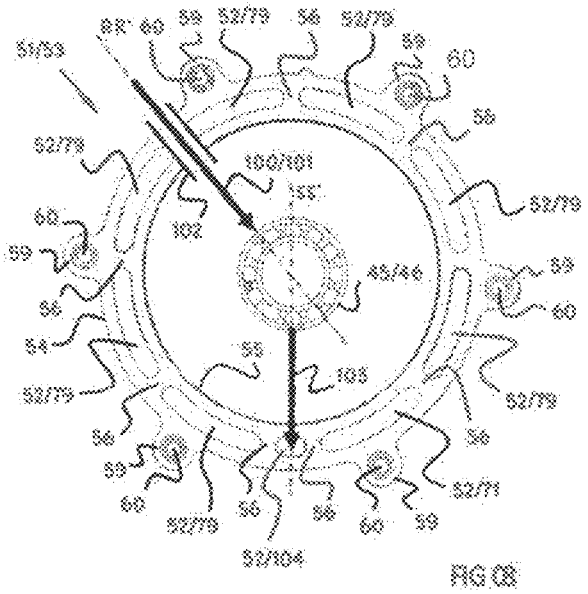
FIG. 8 is a front view on the finished central motor housing body indicated by arrow F08 in FIG. 6, wherein a motor shaft bearing and oil injection to that motor shaft bearing is illustrated.

In FIG. 8 is illustrated how these oil injection lines 100 and 101 for supplying filtered and cooled oil 49 towards the motor bearings 45 and 46 are realized. For each bearing 45 and 46 supporting the motor shaft 4 an oil injection channel 102 is provided through the motor housing 3 for supplying filtered oil to a concerned motor shaft bearing 45 or 46.

In a possible embodiment these oil injection channels 102 extends through one of the covers 61 or 61 of the motor jacket 51 or through the motor jacket 51 itself.

In a similar way there are also oil drain channels 103 for draining filtered lubrication oil 49 from the concerned motor shaft bearing 45 or 46 out of the motor housing and back to the oil reservoir 47.

These oil injection channels 102 and oil drain channels 103 are extending in a radial direction RR' or SS' towards the motor shaft 4 or away from the motor shaft 4 or comprise at least a part which is extending in such a radial direction RR' or SS'.

In a preferred embodiment of a compressor assembly 1 according to the invention the motor housing 3 is provided with an axially extending pass-through channel 104, which is in principle similar to the pass-through channel 68 for the oil-pump pressure line 73 and which passes through the central motor housing body 51 and through openings in the motor housing covers 61 and 62 provided at opposite ends 57 and 58 of the central motor housing body 51.

This axially extending pass-through channel 104 is a drain channel 104 and is forming a part of oil drain lines 105 for draining oil 49 coming from the motor shaft bearings 45 and 46 towards the oil reservoir 47. The axially extending pass-through channel 104 is connected to the afore-mentioned radially extending parts 103 for forming the oil drain lines 105. The flow of drained oil 49 is indicated in FIGS. 9 to 12 by arrows DC.

In another embodiment of a compressor assembly 1 in line with the invention the oil injection channels 102 can also be executed in a similar way as the axially extending pass-through channel 104, by integrating also these oil injection channels 102 in the motor jacket 51 in an axially extending channel 52 of the motor jacket 51.

Furthermore, the pass-through drain channel 104 is located at the bottom of the motor jacket 51 for receiving lubrication oil 49 for example under the influence of gravity forces, typically in a setup where the motor 2 is oriented horizontally. In other configurations the motor 2 is extending in a vertical direction, which is for example typically the case in oil-injected screw compressor elements and in such a case the lubrication oil 49 flows under the pressure of other forces, typically a driving force generated by an oil pump. It is substantially smaller in cross-sectional size than the other channels 71 and 79 for the oil-pump pressure line 73 and the motor jacket 51 cooling.

Of course, the oil 47 supplied to the compressor components through oil injection lines 90-99 needs also to be drained back to the oil reservoir 47. To that purpose the oil circulation system 33 of the compressor assembly 1 of FIG. 3 comprises the following oil drain lines:

an oil drain line 106 for draining oil coming from a compressor rotor 11 or 12;

oil drain lines 107 and 108 coming from a driven gearwheel 36 or a driving gearwheel 37 of an intermediate gearwheel transmission 34 between the motor 2 and the compressor element 9;

an oil drain line 109 for draining oil 49 coming from a non-drive side bearing 21 of a female compressor rotor shaft 17;

an oil drain line 110 for draining oil coming from a non-drive side bearing 23 of a male compressor rotor shaft 18;

an oil drain line 111 for draining oil 49 coming from a drive side bearing 22 of a female compressor rotor shaft 17;

an oil drain line 112 for draining oil 49 coming from a drive side bearing 24 of a male compressor rotor shaft 18; and, an oil drain line 113 for draining oil 49 coming from timing gearing 28 or 29.

All these oil drain lines 106 to 113 come together and guide the oil 49 back to the oil reservoir 47 for being sucked up again by the oil-pump 32 for a next cycle through the oil circulation system 33.

Figure 4:
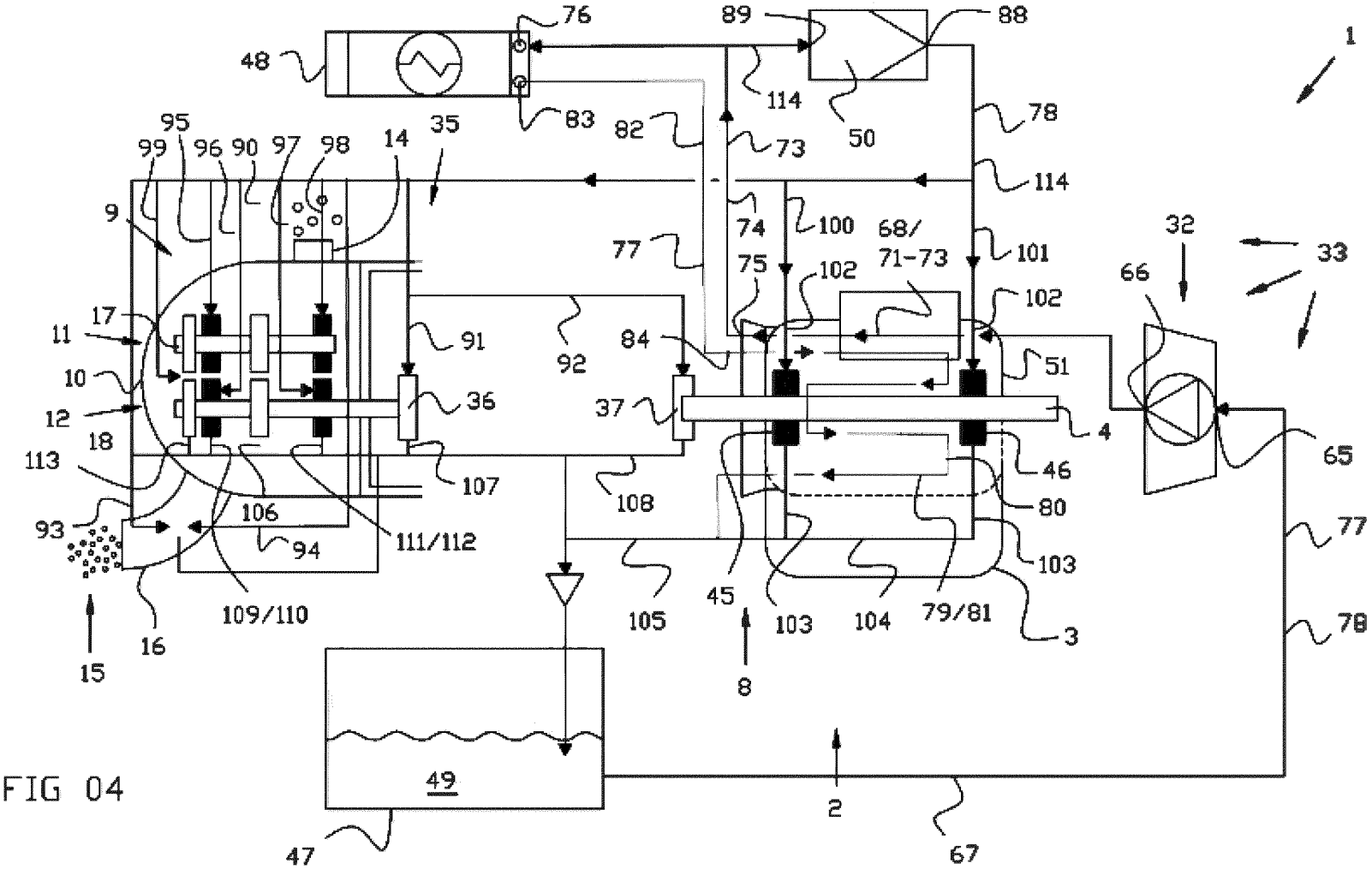
FIG. 4 is a schematic representation similar to the one of FIG. 2 of a complete compressor assembly in accordance with the invention comprising an oil-free compressor element with uncooled oil injection.

FIG. 4 illustrates in a similar way as in FIG. 3 another embodiment of a compressor assembly 1 in accordance with the invention in its entirety.

The greater part of the composing elements are the same as in FIG. 3 and are also indicated with the same reference numbers. The main difference with the embodiment of FIG. 3 is that in the embodiment of FIG. 4 the oil 49 which is supplied to the elements of the compressor element 9 and the bearings 45 and 46 of the motor 2 for being lubricated is not pre-cooled as was the case in the embodiment of FIG. 3.

In the example of FIG. 4 the oil circulation system 33 of the compressor assembly 1 comprises oil injection lines 90-101 for providing uncooled, filtered lubrication oil 49 to components of the compressor assembly 1. This time the oil filter 50 is provided in an oil-line 114 of uncooled oil 49 which is branched-off from the oil-pump pressure line 73 provided between the oil-pump 32 and the oil-cooler 48. This oil-pump pressure line 73 passes again partly through the motor jacket 51 through a pass-through 68.

So, the main difference is that in the embodiment of FIG. 3 the oil filter 50 is placed in an oil line branch 86, which is downstream of or behind the oil-cooler 48, while in the embodiment of FIG. 4 the oil filter is placed in an oil line branch 114, which is upstream of or in front of the oil-cooler 48. Apart from the fact that the oil 49 is not cooled before being supplied to the concerned components for lubrication, there is furthermore no other essential difference between both compressor assemblies 1.

Figure 5:
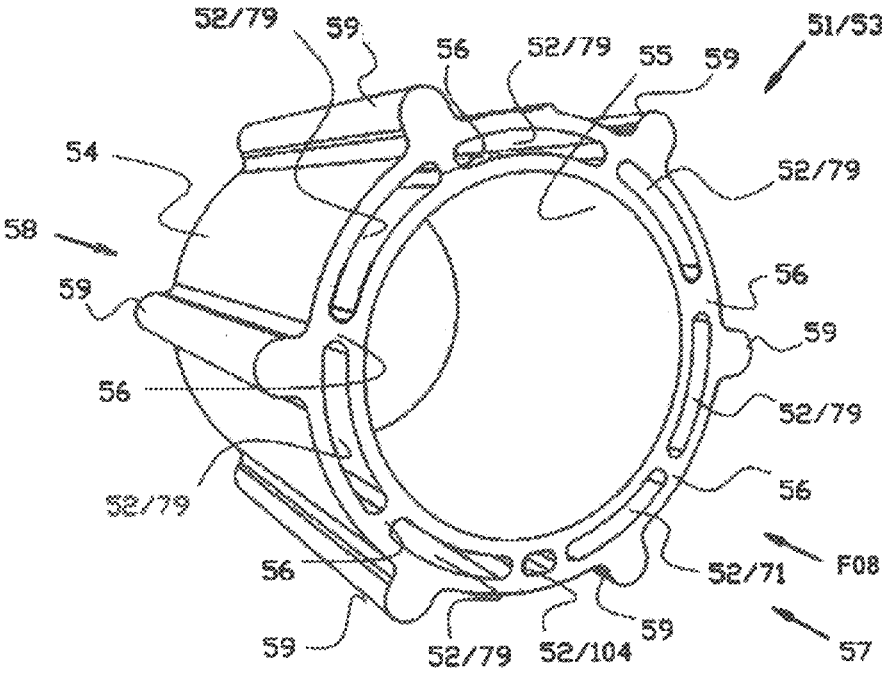
FIG. 5 represents a perspective view of a non-finished central motor housing body of a compressor assembly according to the invention.
Figure 6:
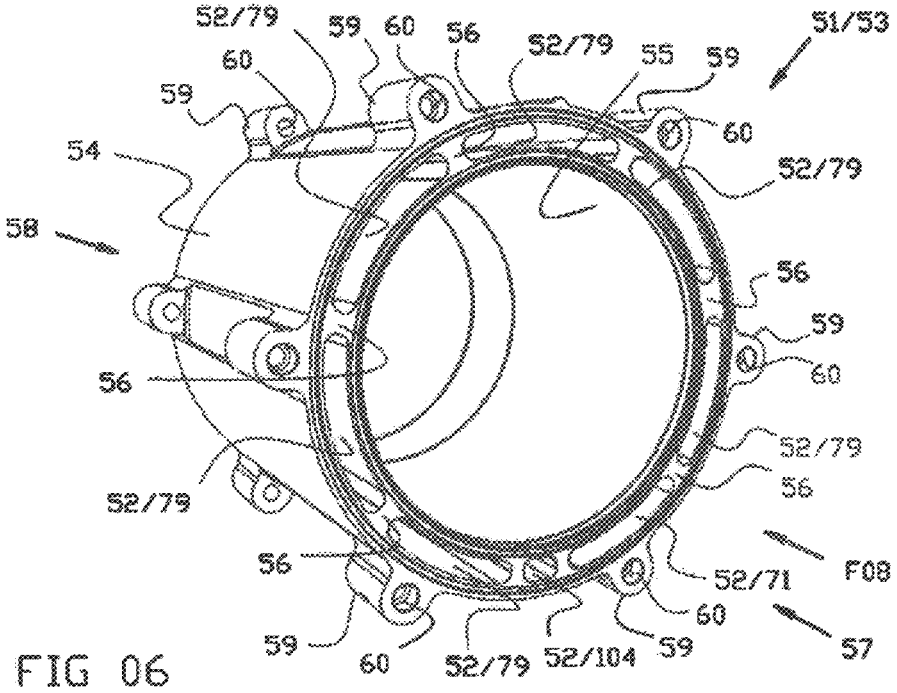
FIG. 6 illustrates a perspective view of a finished version of the same central motor housing body represented in FIG. 5.

FIGS. 5 to 7 illustrate consecutive steps during the fabrication of the central motor housing body 51 of the electric motor according to a method of the invention.

According to the invention the manufacturing of the central motor housing body 51 of the compressor assembly 1 comprises an extrusion step for forming a motor jacket 51 with axially directed channels 52.

FIG. 5 illustrates the still unfinished situation just after the extrusion step has been executed. The central motor housing body 51 has a cross-section which is essentially constant or invariable over at least an important axial part of the central motor housing body 51 and it has already all the important features, also present in the finished central motor housing body 51, such as the shape of a cylindrical, double-walled element 53 wherein axially directed channels 52 are provided between an inner wall 55 and an outer wall 54 separated by partition walls 56. The bulges 59 provided externally on the outside wall 54 are still unfinished and are axially aligned bulges which extend over the total length of the central motor housing body 51.

FIG. 6 illustrates the result after execution of a next step of the method of the invention, wherein intermediate parts of the bulges 59 are removed in a milling or cutting operation. Holes 60 are furthermore provided in the bulges 59, which are possibly provided with an internal thread, or which are executed simply as through-holes 60 without internal thread.

Finally, FIG. 7 illustrates the central motor housing body 51 after the stator 6 of the motor has been inserted in the double-walled, cylindrical element 53.

Figure 11:
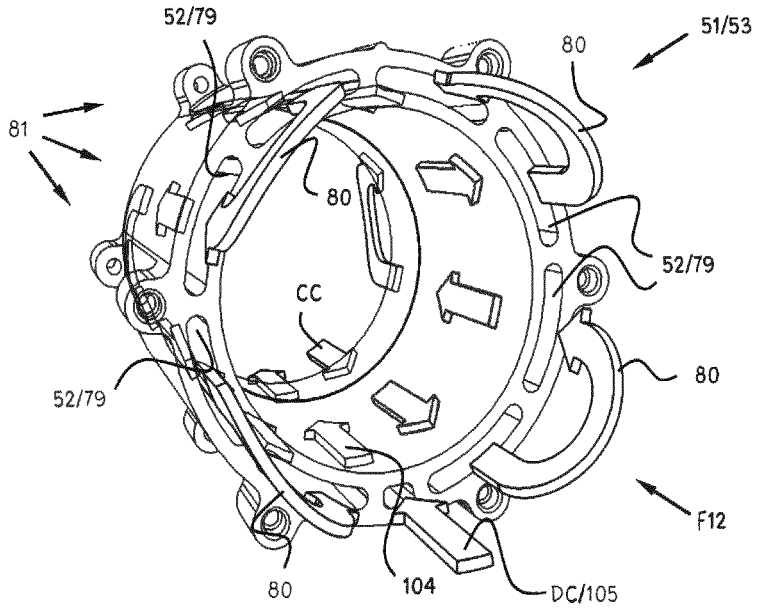
FIG. 11 is a perspective view on the finished central motor housing body similar to the perspective view of FIG. 9 wherein the direction of oil flow in a second configuration is indicated by means of arrows.
Figure 12:
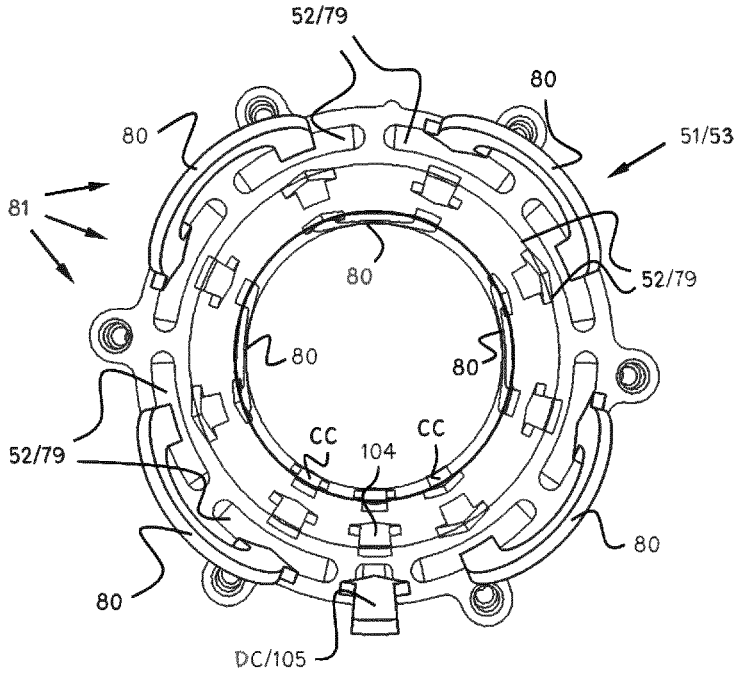
FIG. 12 is a front view along the arrow F12 in FIG. 11 illustrating the same oil flows in the second configuration through the channels in the finished central motor housing body; and, FIG. 13 is a perspective representation of a partly exploded view of a more realistic version of a compressor assembly in accordance with the invention.

FIGS. 11 and 12 illustrate a part of a configuration of the oil circulation system 33 in line with the invention which is slightly different from the configuration represented in FIGS. 9 and 10.

The difference is that in the embodiment of FIGS. 11 and 12 there is one channel 52 less in the central motor housing body 51 than is the case in the embodiment of FIGS. 9 and 10. The channel 71 which forms a part 72 of the oil-pump pressure line 73 is omitted in the embodiment of FIGS. 9 and 10. As a consequence, the oil-pump pressure line 73 is this time not integrated in the motor jacket 51 and in this example the oil-pump suction line 67 and the oil-pump pressure line 73 should be both connected externally to the oil-pump.

Similarly, it is not excluded from the invention to omit the integrated drain channel 104 at the bottom of the motor jacket 51 and to drain for example the oil coming from the motor bearings 45 and 46 directly into an underlying oil sump.

Still other configurations are of course not excluded from the invention and the axially aligned channels 52 in the motor jacket can have a completely different shape or size and the number of channels 52 provided, can be increased or decreased and so on.

Excluding the oil-pump pressure line 73, oil injection lines 102 and/or oil drain line 104 (or any other non-cooling channel) from being integrated in the motor jacket 51 has an advantage in that the cooling performance of the motor 2 can be increased. On the other hand, integrating more oil lines in the motor jacket 51 is advantageous in that the motor 2 can be executed in a more compact format. Possible interesting candidates which could be additionally integrated in the motor jacket 51 for increasing the compactness of the assembly 1 and for reducing risk for oil leaks, is for example oil-pump suction line 67 or any oil injection line 90-101. A disadvantage however of increased integration of oil lines in the motor jacket 51 is that the cooling power of the motor 2 is in that case somewhat reduced.

The present invention is in no way limited to the embodiments of a compressor assembly 1 as described before, but such a compressor assembly 1 can be applied and be implemented in many different ways without departure from the scope of the invention.

The present invention is also not limited to the methods for fabricating a part of such a compressor assembly 1 as described in this text, but other methods can be applied for that pursue in many different ways without departure from the scope of the invention.

The invention claimed is:

1. A compressor assembly comprising a motor which drives one or more compressor rotors of a compressor element, comprising an oil circulation system for cooling and lubricating components of the compressor assembly, wherein the oil circulation system comprises an oil reservoir, an oil cooler for cooling oil circulating through the oil circulation system, and an oil filter for filtering oil flowing through one or more lines of the oil circulation system, wherein the motor has a motor housing comprising a central motor housing body executed as a motor jacket in which channels are provided which are connected to oil lines of the oil circulation system for circulating oil through the motor jacket, and wherein the oil circulation system comprises an oil-pump for providing driving force for circulating oil through oil lines of the oil circulation system from the oil reservoir to said components of the compressor assembly and back to the oil reservoir, and the channels in the motor jacket extend in axial directions parallel to the axial direction of a motor shaft of the motor, wherein the oil circulation system of the compressor assembly comprises at least a first circulation loop and a second circulation loop wherein oil is circulating between the oil reservoir and the oil cooler and back, wherein the first circulation loop is an unfiltered circulation loop wherein no oil filter is included and the second circulation loop is a filtered circulation loop in which the oil filter is provided for filtering the oil and wherein one or more channels in the motor jacket are included in the first unfiltered circulation loop, which channels form cooling channels for cooling of the motor housing jacket.

2. The compressor assembly according to claim 1, wherein the oil-pump is driven by the shaft of the motor and is either integrated in the motor housing or is mounted on a motor housing cover or on another part of the compressor assembly housing provided at a non-drive side or at a drive side of the central motor housing body.

3. The compressor assembly according to claim 1, wherein the oil-pump has an outlet directly connected to a pass-through channel formed by one of the channels in the motor jacket and an opening fitted to said one of the channels.

4. The compressor assembly according to claim 1, wherein the compressor element of the compressor assembly is an oil-free or oil-less compressor element.

5. The compressor assembly according to claim 4, wherein the compressor element of the compressor assembly is an oil-less rotor compressor or is an oil-less tooth compressor element wherein the one or more compressor rotors driven by the motor are one or more compressor rotors or compressor teeth.

6. The compressor assembly according to claim 1, wherein the central motor housing body has a cross-section which is essentially constant or invariable over at least an axial part of the central motor housing body.

7. The compressor assembly according to claim 1, wherein the central motor housing body is fabricated by extrusion.

8. The compressor assembly according to claim 1, wherein the motor housing is provided with a pass-through channel, which passes through the central motor housing body and through motor housing covers provided at opposite ends of the central motor housing body and wherein the outlet of the oil-pump is directly connected to this pass-through channel and is forming a part of an oil-pump pressure line of the oil-pump.

9. The compressor assembly according to claim 1, wherein the motor of the compressor assembly is an electric motor comprising a motor stator which is inserted in the motor housing and a motor rotor mounted on the motor shaft which is extending through the motor stator.

10. The compressor assembly according to claim 1, wherein the motor housing comprises additionally at a drive side of the central motor housing body a drive side motor housing cover adjacent to the one or more compressor rotors driven by the motor and comprises at a non-drive side of the central motor housing body a non-drive side motor housing cover at the opposite side of the central motor housing body, wherein the motor housing covers comprise one or more interconnection channels which collaborate with the cooling channels in the motor jacket of the central motor housing body for interconnection with the cooling channels to form a single or multiple composed cooling channel(s) for cooling of the motor jacket.

11. The compressor assembly according to claim 10, wherein the motor housing covers comprise one or more pass-through openings which collaborate in the assembled status with a channel in the central motor housing body for forming a pass-through channel through the motor housing.

12. The compressor assembly according to claim 1, wherein at a driven side of the motor the motor shaft is coupled to one or more of the compressor rotors, directly by a direct coupling or indirectly by means of or through a gearwheel transmission.

13. The compressor assembly according to claim 1, wherein the oil-pump is coupled directly to or is mounted on the motor shaft at a non-driven side of the motor opposite to a driven side where the motor shaft is coupled to one or more compressor rotors.

14. The compressor assembly according to claim 1, wherein the oil-pump is at its inlet connected to an oil-pump suction line which is provided between the oil reservoir and the oil-pump and is at its outlet connected to an oil-pump pressure line which connects the oil-pump to the inlet of the oil cooler.

15. The compressor assembly according to claim 1, wherein the oil circulation system of the compressor assembly comprises one or more oil injection lines for providing cooled filtered lubrication oil to components of the compressor assembly and wherein the oil filter is provided in an oil-line of cooled oil which is connected to the oil cooler outlet.

16. The compressor assembly according to claim 1, wherein for the motor jacket cooling an oil line of cooled oil is provided between the oil-cooler outlet and at least one cooling channel in the central motor housing body jacket or a one or more composed cooling channel(s) which is composed of several cooling channels in the central motor housing body jacket which are interconnected by means of interconnection channels in motor housing covers of the central motor housing body, wherein an oil-line of cooled oil is connected to the oil cooler outlet which is branched upstream of the oil-filter into a first branch towards the oil-filter and a second branch towards said cooling channel or one or more composed cooling channel(s) in the motor housing jacket.

17. The compressor assembly according to claim 1, wherein the oil circulation system of the compressor assembly comprises one or more oil injection lines for providing uncooled filtered lubrication oil to components of the compressor assembly and wherein the oil filter is provided in an oil-line of uncooled oil which is branched-off from an oil-pump pressure line provided between the oil-pump and the oil-cooler.

18. The compressor assembly according to claim 1, wherein the oil circulation system of the compressor assembly comprises one or more oil injection lines for providing filtered lubrication oil to components of the compressor assembly, which oil injections lines include one or more of the following:

- a filtered oil injection line towards a compressor rotor;
- filtered oil injection lines towards a driven gearwheel or a driving gearwheel of an intermediate gearwheel transmission between the motor and the compressor element;
- a non-drive side oil injection line for injecting filtered oil towards a compressor outlet;
- a drive side oil injection line for injecting filtered oil towards a compressor outlet;
- a filtered oil injection line towards a non-drive side bearing of a female compressor rotor shaft;
- a filtered oil injection line towards a non-drive side bearing of a male compressor rotor shaft;
- a filtered oil injection line towards a drive side bearing of a male compressor rotor shaft;
- filtered oil injection line towards a drive side bearing of a female compressor rotor shaft;
- a filtered oil injection line towards timing gearing;
- a drive side filtered oil injection line towards a motor shaft bearing; and/or,
- a non-drive side filtered oil injection line towards a motor shaft bearing.

19. The compressor assembly according to claim 1, wherein in the motor housing for each bearing supporting the motor shaft an oil injection channel is provided for supplying filtered oil to a concerned motor shaft bearing as well as an oil drain channel for draining filtered lubrication oil from the concerned motor shaft bearing.

20. The compressor assembly according to claim 19, wherein the oil injection channels and oil drain channels extend in a radial direction towards the motor shaft or away from the motor shaft or comprise at least a part which extends in a radial direction.

21. The compressor assembly according to claim 20, wherein the motor housing is provided with a pass-through channel extending in the axial direction, which passes through at least the central motor housing body and wherein the pass-through channel is a part of an oil drain line for draining oil coming from the motor shaft bearings and which is connected to the radially extending oil drain channels.

22. The compressor assembly according to claim 1, wherein the oil circulation system of the compressor assembly comprises one or more oil drain lines for draining lubrication oil coming from components of the compressor assembly, which oil drain lines include one or more of the following:

an oil drain line for draining oil coming from a compressor rotor;

oil drain lines coming from a driven gearwheel or a driving gearwheel of an intermediate gearwheel transmission between the motor and the compressor element;

an oil drain line for draining oil coming from a non-drive side bearing of a female compressor rotor shaft;

an oil drain line for draining oil coming from a non-drive side bearing of a male compressor rotor shaft;

an oil drain line for draining oil coming from a drive side bearing of a female compressor rotor shaft;

an oil drain line for draining oil coming from a drive side bearing of a male compressor rotor shaft;

an oil drain line for draining oil coming from timing gearing;

a drive side oil drain line for draining oil coming from a motor shaft bearing; and/or, a non-drive side oil drain line for draining oil coming from a motor shaft bearing.

23. A method for fabricating a housing part of a compressor assembly according to claim 1, wherein the manufacturing of the central motor housing body of the compressor assembly comprises an extrusion step for forming a motor jacket with axially directed channels.

* * * * *